US008973875B2

(12) United States Patent
Cuadrado et al.

(10) Patent No.: US 8,973,875 B2
(45) Date of Patent: Mar. 10, 2015

(54) UNIVERSAL HEAVY BAG HANGER

(75) Inventors: Xavier A. Cuadrado, Brooklyn, NY (US); Jason Whitworth, Brooklyn, NY (US)

(73) Assignee: Everlast Worlds Boxing Headquarters Corporation, New York, NY (US)

( * ) Notice: Subject to any disclaimer, the term of this patent is extended or adjusted under 35 U.S.C. 154(b) by 0 days.

(21) Appl. No.: 12/787,156

(22) Filed: May 25, 2010

(65) Prior Publication Data

US 2012/0091294 A1 Apr. 19, 2012

(51) Int. Cl.

| | |
|---|---|
| ***B65B 67/12*** | (2006.01) |
| ***A63B 69/20*** | (2006.01) |
| *A47B 96/06* | (2006.01) |
| *A47G 29/00* | (2006.01) |
| *A47K 1/00* | (2006.01) |
| *E04G 3/00* | (2006.01) |
| *F21V 21/00* | (2006.01) |
| *F21V 35/00* | (2006.01) |
| *F16M 11/00* | (2006.01) |
| *A45C 13/00* | (2006.01) |
| *A45F 5/00* | (2006.01) |
| *A45F 3/00* | (2006.01) |

(52) U.S. Cl.

CPC ..... *A63B 69/201* (2013.01); *A45C 13/001* (2013.01); *A45F 5/00* (2013.01); *A45F 2003/001* (2013.01); *A63B 2209/10* (2013.01); *A63B 2225/09* (2013.01)

USPC ..... 248/95; 248/214; 248/682; 248/689

(58) Field of Classification Search

USPC ..... 248/689, 205.2, 214, 95, 101, 226.11, 248/228.1, 228.8, 230.8, 229.17; 482/87; 294/149, 150, 165; 224/254, 677, 220

See application file for complete search history.

(56) References Cited

U.S. PATENT DOCUMENTS

| | | | | | |
|---|---|---|---|---|---|
| 1,490,066 | A | * | 4/1924 | Carr | 224/577 |
| 1,546,067 | A | * | 7/1925 | Goldschmidt | 224/264 |
| 2,449,882 | A | * | 9/1948 | Daniels | 604/179 |
| 3,193,235 | A | * | 7/1965 | Jensen | 248/317 |
| 3,831,740 | A | * | 8/1974 | Pendergast et al. | 206/287 |
| 3,919,740 | A | | 11/1975 | Scherb | |
| 4,453,933 | A | * | 6/1984 | Speaker | 604/179 |
| 4,593,901 | A | * | 6/1986 | Moore et al. | 482/87 |
| 4,639,980 | A | * | 2/1987 | Peterson | 24/306 |
| 4,927,211 | A | * | 5/1990 | Bolcerek | 297/465 |
| 5,008,987 | A | * | 4/1991 | Armour, II | 24/442 |
| 5,075,933 | A | * | 12/1991 | Kemper | 24/16 R |
| 5,293,657 | A | | 3/1994 | DeAth | |
| 5,347,669 | A | * | 9/1994 | Neviaser et al. | 5/655 |
| 5,511,756 | A | * | 4/1996 | Spradling | 248/316.7 |

(Continued)

*Primary Examiner* — Jonathan Liu

(74) *Attorney, Agent, or Firm* — Myron Greenspan; Lackenbach Siegel LLP

(57) ABSTRACT

The universal heavy bag hanger is used to secure a heavy bag to an overhead horizontal support member. The bag hanger includes a flat pad that has a length along a length direction to wrap around a support member. The pad includes a slip resistant material that engages the support member when mounted thereon. A strap is secured to the outside surface and extends beyond the longitudinal ends of the flat pad. A D-shaped ring is attached to one free end of the strap suitable for attachment to a heavy bag or the like. The other end of the strap is provided with a rectangular closed ring dimensioned to allow the D-shaped ring to pass through it to form a slip joint for tightening the strap about the pad, when increased load is applied to prevent or inhibit relative sliding movements between the hanger and the support member.

18 Claims, 4 Drawing Sheets

(56) References Cited

U.S. PATENT DOCUMENTS

| | | | | | |
|---|---|---|---|---|---|
| 5,544,795 | A * | 8/1996 | Perrin | 224/254 |
| 5,577,516 | A * | 11/1996 | Schaeffer | 128/877 |
| 5,586,969 | A * | 12/1996 | Yewer, Jr. | 602/19 |
| 5,590,826 | A * | 1/1997 | Endo | 224/264 |
| 5,695,102 | A * | 12/1997 | Jackson | 224/264 |
| 5,738,080 | A * | 4/1998 | Brocco, Jr. | 124/86 |
| 5,800,319 | A * | 9/1998 | Choate | 482/83 |
| 5,916,199 | A * | 6/1999 | Miles | 604/174 |
| 6,113,577 | A * | 9/2000 | Hakky et al. | 604/174 |
| 6,202,236 | B1 * | 3/2001 | Price | 5/657 |
| 6,273,376 | B1 * | 8/2001 | Montgomery | 248/214 |
| 6,296,164 | B1 * | 10/2001 | Russo | 224/602 |
| 6,461,281 | B2 * | 10/2002 | Bouvier | 482/86 |
| 6,910,227 | B2 * | 6/2005 | Lee | 2/268 |
| 7,080,856 | B2 * | 7/2006 | Desmarais et al. | 280/808 |
| 7,243,825 | B2 * | 7/2007 | Weisenfeld | 224/311 |
| 7,284,730 | B2 * | 10/2007 | Walsh et al. | 248/74.3 |
| 7,419,125 | B2 * | 9/2008 | Simone | 248/102 |
| 7,810,654 | B1 * | 10/2010 | Wang | 211/106.01 |
| 2002/0010057 | A1 * | 1/2002 | Bouvier | 482/86 |
| 2004/0221373 | A1 * | 11/2004 | Lee | 2/268 |
| 2006/0000858 | A1 * | 1/2006 | Jung | 224/264 |
| 2006/0138290 | A1 * | 6/2006 | Vitito | 248/205.2 |
| 2008/0301999 | A1 * | 12/2008 | Bergers | 43/55 |

* cited by examiner

UNIVERSAL HEAVY BAG HANGER

BACKGROUND OF THE INVENTION

1. Field of the Invention

The invention generally relates to strap hangers, and, more specifically, to a universal heavy bag hanger for securing a heavy bag or the like to an overhead horizontal support member.

2. Description of the Prior Art

Heavy punching bags can weigh as much as 150 lb. Such bags, especially those for professional use, can exert significant forces on any mounting structure on which they are supported. Heavy bag hangers come in many different forms. Some of such hangers are metal brackets configured to be screwed into wooden beams, with or without swivels. Heavy bag hangers are also made for attachment to joists. Some heavy duty bag hangers are also designed to be supported by I-beams and are adjustable to accommodate a range of I-beam widths.

Aside from overhead mounting structures, heavy duty wall mounts are also known, typically in the form of a horizontal cantilevered beam or member attached to a wall at one end with the heavy bag mounted from the other end. However, to stabilize the cantilevered beam or member lateral braces are typically provided to maintain the horizontal beam in a fixed position normal to the wall or support surface. Also, because some heavy bags are extra long, reaching approximately 4 feet, they cannot be mounted too close to a wall since the bag would hit the supporting wall or surface. For this reason, some wall mounted hangers have supporting beams that reach 26 inches or more from the wall. However, the longer the supporting beam and the further the bag is mounted from the wall, the more heavily the supporting beam must be braced to the wall to prevent undesired movements. This makes some wall hangers massive, heavy and costly.

The disadvantages of all of the aforementioned heavy bag hangers is that they require tools and fasteners to be mounted. Because heavy bags weigh, as indicated, up to 150 lb, the fasteners tend to be substantial and inserting the fasteners into joists or wooden beams can be difficult and may require the use of power tools.

Heavy bags have, accordingly, also been supported by free-standing heavy bag stands or multiple station gyms. However, such stands and gyms tend to have large footprints and require extensive assembly. Furthermore, such bag stands and gyms can be very costly, ranging into the thousands of dollars.

Some hangers for suspending other objects that do not require installation or use of tools are also known.

U.S. Pat. No. 6,273,376 to Montgomery discloses a hanger holder for use in the laundry cleaning industry. The patent discloses a device for organizing and holding a group of clothes hangers in a laundry basket. The hanger holder includes an elongate strap in two different embodiment. In both cases, the strap is designed to loop about the laundry basket and Velcro pads or strips are used to secure the hanger or hangers to the device.

U.S. Pat. No. 5,293,657 to DeAth discloses a suspension device for hammocks and other objects. The device includes a shorter and wider gripping belt and a more narrow and longer spanning belt, loops being used to secure the belt to the gripping belt or strap. The remote ends of the belt are provided with securing means, such as a snap hook, for securing to a hammock. The device is intended to suspend a variety of objects from a variety of load bearing members. Although the device is shown used to secure a hammock to a tree, which is vertical, it is believed that the intention of the patented device is to a secure variety of objects to numerous load bearing members with little or no slippage. The gripping belt is described as being made of a material of sufficient strength and quality to support the load of the hammock and be sufficiently pliable to conform to the shape of the load bearing members and made of a material such as polypropylene, nylon or polyester. However, the patent does not teach or suggest the use of reinforcing members, such as steel bars or strips nor the use of a rubberized or other like inside surface to enhance friction. Additionally, the suspension device of this patent is not a self adjusting and self-locking or tightening device that increases the grip and frictional forces on the support member as a function of the weight or load applied.

In Kemper U.S. Pat. No. 5,075,933 a cable locking and retaining device is disclosed for supporting relatively light weight objects, such as extension cords, by means of a belt using a simple VELCRO strap.

In U.S. Pat. No. 3,919,740 to Scherb a flexible strap hanger is disclosed for use in hanging fresh meats, such as beef, to be suspended from an overhead support. The device uses a sliding bar fastener that can slide along the straps to receive an upper loop and allow the strap to be secured to an overhead bar.

However, none of the known hanging or suspending devices allow a heavy bag to be easily, quickly and conveniently mounted on or removed from any horizontal beam or support member without the use of hand tools or power tools.

SUMMARY OF THE INVENTION

Accordingly, it is object of the invention to provide a heavy bag hanger that does not have the disadvantages inherent in existing heavy bag hanging devices.

It is another object of the invention to provide a universal heavy bag hanger that can be used to mount a heavy bag on any elongate beam or support member irrespective of its girth, circumference, perimeter, periphery or cross-sectional configuration.

It is still another object of the invention to provide a universal heavy bag hanger that is simple and convenient to use.

It is yet another object of the invention to provide a universal heavy bag hanger for mounting a heavy bag on any elongate horizontal support member that prevents the heavy bag from slipping and moving along the length direction of the support member even after extended use of the heavy bag.

It is a further object of the invention to provide a universal heavy bag hanger of the type under discussion that distributes the forces, reflecting the weight of the heavy bag as well as the blows thereto, over a surface area greater than the surface area of a supporting belt or strap to thereby prevent or reduce damage to the supporting member.

It is still a further object of the invention to provide a universal heavy bag hanger that is simple in construction and economical to manufacture.

It is yet a further object of the invention to provide a universal heavy bag hanger as in the previous objects that has the ability to adjust the height of the heavy bag when mounted on an overhead support member.

In order to achieve the above objects as well as others that will become here and thereafter, a universal heavy bag hanger in accordance with the invention for securing a heavy bag to an overhead horizontal support member having a predetermined cross-sectional girth or perimeter includes an elongate generally flat pad. The pad defines a length direction and a transverse width direction and has a length along said length direction sufficient to at least partially wrap around the support member. The pad has an inside surface for contacting the support member and an opposing outside surface. A slip resistant material is provided on at least part of said inside surface. A strap is secured to said outside surface extending beyond the longitudinal ends of said flat pad. Said strap has two free ends. First attachment means is attached to one free end of said strap for attaching to a heavy bag or the like. As second attachment means is attached to the other free end of said strap for cooperating with said free end to form a slip joint for tightening said strap about said flat pad and the support member for increasing tension applied to said other end. In this manner, resulting constricting action of said strap about said pad increases the frictional forces between said slip resistant material and the support member to thereby prevent sliding movements therebetween when force components along said length and transverse width directions are applied to said first attachment means and the heavy bag or the like attached thereto. In accordance with one presently preferred embodiment, force distributing means are provided for distributing forces applied to the strap to the support member to minimize or eliminate damage to the support member with extended use.

BRIEF DESCRIPTION OF THE DRAWINGS

Those skilled in the art will appreciate the improvements and advantages that derive from the present invention upon reading the following detailed description, claims, and drawings, in which:

DESCRIPTION OF THE PREFERRED EMBODIMENTS

Figure 1:
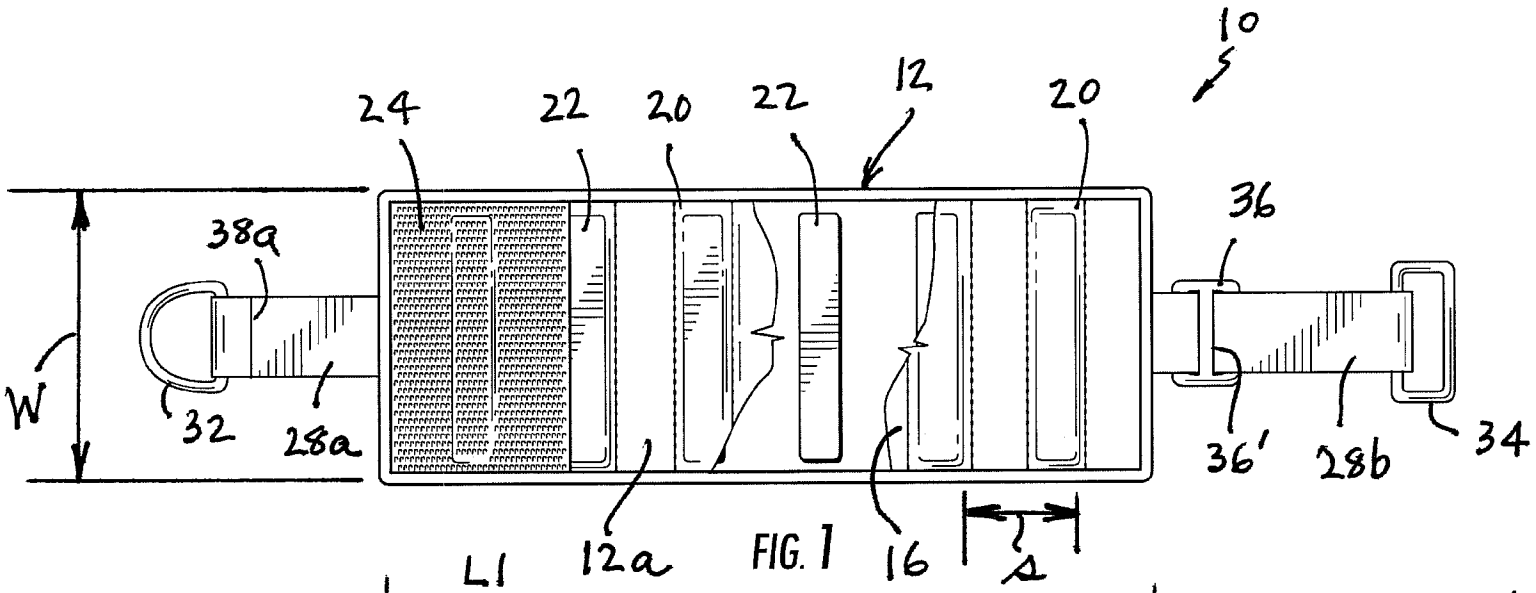
FIG. 1 is a top plain view of a universal heavy bag hanger for securing a heavy bag to an overhead horizontal support member in accordance with the present invention, partially broken away to illustrate one of the transverse rigid force distributing bars.
Figure 2:
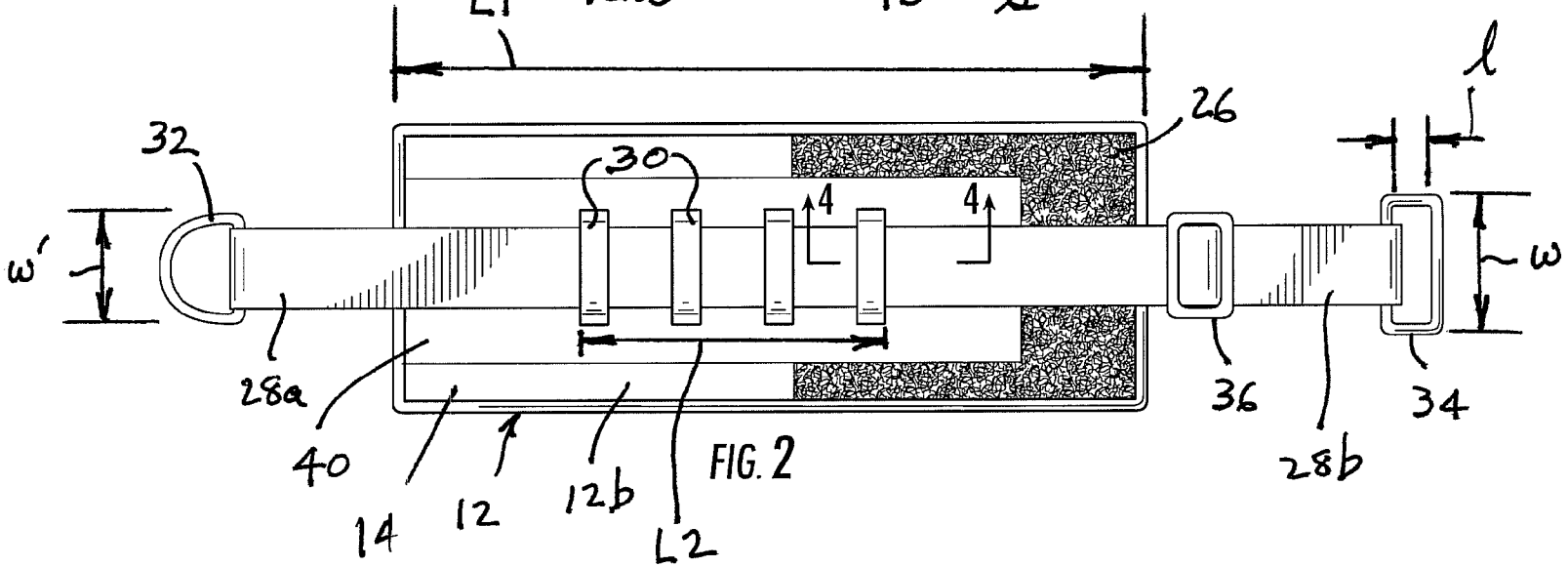
FIG. 2 is a bottom plain view of the universal heavy bag hanger shown in FIG. 1.

Referring now specifically to Figures in which similar or identical parts are designated by the same reference numerals troughout, and referring first to FIGS. 1 and 2, a universal heavy bag hanger in accordance with the present invention is generally designated by the reference numeral 10. The hanger 10 is suitable for securing a heavy bag to an overhead horizontal support member S, having a predetermined cross-sectional girth, circumference, perimeter or periphery. The hanger 10 can also be used irrespective of the nature of the horizontal support member, whether it is an I-beam or other metal beam, or other support members having square, rectangular, circular or any other cross-sectional configurations.

Still referring to FIGS. 1 and 2, the hanger 10 includes an elongate generally flat pad 12 defining a length direction and a transverse width direction. The pad 12 has a length L1 along its length direction and a transverse width W along the transverse width direction. The length L1 is selected to allow at least part of the pad to be wrapped around the support member S. In a presently preferred embodiment, L1 is approximately equal to 21 inches and the width W is equal to approximately 7.25 inches.

The pad 12 has an inside or internal surface 12*a* for contacting the support member S, as to be described, and an opposing outside or exterior surface 12*b*.

Figure 4:
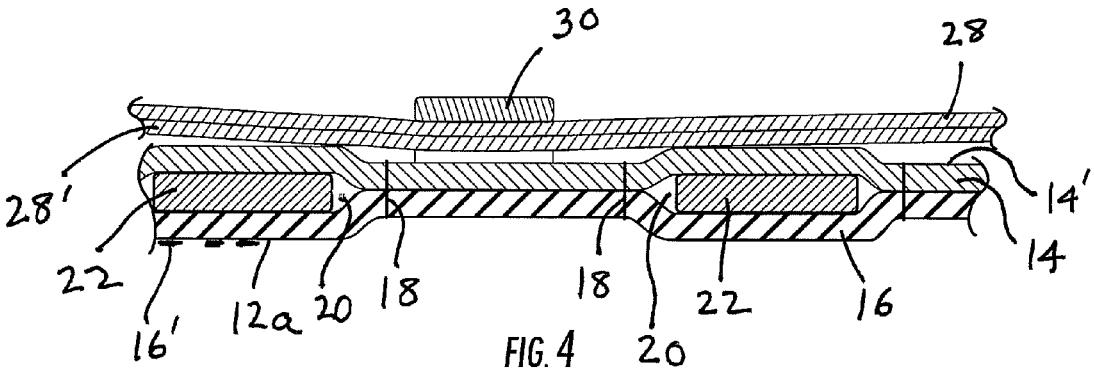
FIG. 4 is cross-sectional view of the universal heavy bag hanger shown in FIG. 2, taken along line 4-4.

Referring also to FIG. 4, a slip resistant material is provided on at least part of the inside surface 12*a*. In the presently preferred embodiment, the pad 12 is formed of a superimposed top sheet 14 and a bottom sheet 16. The bottom sheet 16 is formed is formed of a slip resistant material and, in the presently preferred embodiment, such lower sheet is made of a rubberized material such as textured neoprene rubber. A textured surface is preferably used to increase or enhance the friction and thereby the gripping ability of the hanger to the support member S.

The top sheet 14 is preferably formed of a PVC sheet material, advantageously formed with reinforced polyester backing to provide strength and reduce stretch of the pad along the length direction.

A strap 28 is slidingly secured to the outside surface 12*b* and extends beyond the longitudinal ends of the pad, the strap having two free ends 28*a*, 28*b*, as shown. However, the strap 28 may also be permanently attached to the outside surface, with different degrees of advantage. One free end 28*a* of the strap is secured to an attachment member used to attach the hanger to a heavy bag or other like heavy object. In the presently preferred embodiment, such attachment member is a first closed ring 32 having a width w'. While any sufficiently strong closed ring can be used, including a split ring, the ring in the presently preferred embodiment is in a form of a D-shaped ring 32. The second or opposing free end 28*b* is connected to a second attachment member in the form of a second closed ring 34. Again, if sufficiently strong, the second ring can also be a split ring, and has dimensions 1 and w to allow the first or D-shaped ring 32 with its width w' to freely pass theretrough.

The strap 28 is movably secured to the outside surface 12*b* by means of a series of spaced parallel loops 30, restricting the relative movements between the strap 28 and the flat pad 12 to longitudinal directions along the length direction of the pad. The loops extend over a central region L2 (FIG. 2) to allow separation of the strap 28 from the pad at the longitudinal free ends to allow such free ends to be attached to each other, as to be more fully described.

In order to allow the strap 28 to be adjusted in length, the end 28*b* of the strap extends through the rectangular ring 34 and loops around to double up (28, 28' in FIG. 4) through a slide buckle or adjusting slide 36. Such sliding buckles or slide adjusters are well known and described, for example, in the following U.S. Pat. Nos. 4,440,334; 4,760,944; 5,370,286; 5,582,337 and 6,772,485. The slide buckle frictionally fixes the length of the strap 28 at a selected length in a well known manner for such slides.

The strap 28 is preferably formed of a polypropylene webbing, although any other suitable or appropriate material can be used, with different degrees of advantage.

A force distributing design to relieve concentrated points of stress on the support member S consists, in the presently preferred embodiment, of a plurality of spaced parallel transverse rigid bars 22 that are spaced along the length direction of the pad and are relatively narrow, compared to the length dimension L1 and are substantially uniformly spaced at a distance s to allow the pad 12 to freely bend along the length direction of the pad while conforming to the cross-sectional configuration and dimensions of the overhead horizontal support member S on which the hanger is to be mounted.

In the presently preferred embodiment, the flat pad 12 is formed, as noted, of superimposed top and bottom sheets 14, 16, respectively. The top and bottom sheets are attached, such as by stitching, to form elongate transverse pockets 20 therebetween to receive the bars 22 to thereby prevent shifting or movements of the bars relative to each other. This assures that the pad can continue to be bent or flexed along the length direction of the pad even after extended use.

Figure 3:
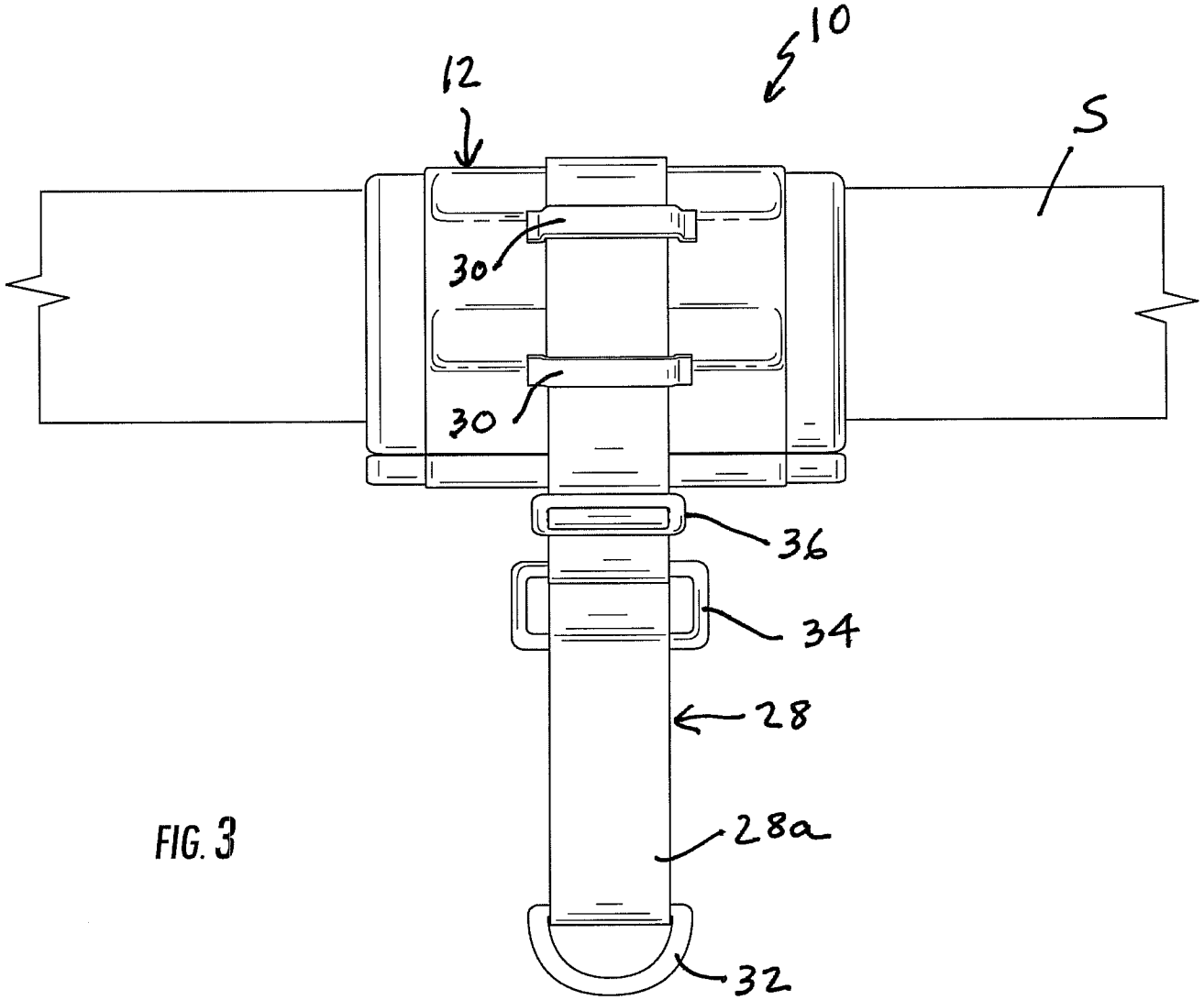
FIG. 3 is side elevational view of the universal heavy bag hanger illustrated in FIGS. 1 and 2, shown when wrapped on an overhead horizontal support member and ready to have a heavy bag suspended from the hanger.

In order to facilitate the application of the hanger 10 to a support post S, there is advantageously provided suitable connecting means for connecting the longitudinal ends of the flat panel to each other when wrapped around the horizontal support member S prior to the application of tension to the strap or constriction of the pad about the support. This is primarily intended to be a temporarily connection to prevent the strap from separating from the post during the mounting procedure. In accordance with the presently preferred embodiment, such connecting means is in a form of mating loop and hook fasteners 24, 26, best shown in FIG. 2. While it is not critical which of the hook or the loop fasteners are applied to either end of the pad, in the presently preferred embodiment, the hook fasteners 24 are attached to the inside surface 12*a* proximate to the D-shaped ring 32 while the loop fasteners 26 are mounted to the exterior surface of the opposing end of the pad, most proximate to the rectangular ring 34. Such hook and loop fasteners are typically marketed under the trademark VELCRO®. The centrally located loops 30 permit unfettered manipulation of the pad's longitudinal ends on which the VELCRO® fasteners 24, 26 have been applied to facilitate attachment of the ends of pad to form a closed loop. Referring also to FIG. 3, it will be clear that wrapping of the pad about the support member S causes the loop and hook fasteners to mate and join in at least temporarily joint together to form a loop about the support member and this prevents the hanger from the inadvertently separating from the support member while the rest of the mounting procedure is effected.

Figure 5:
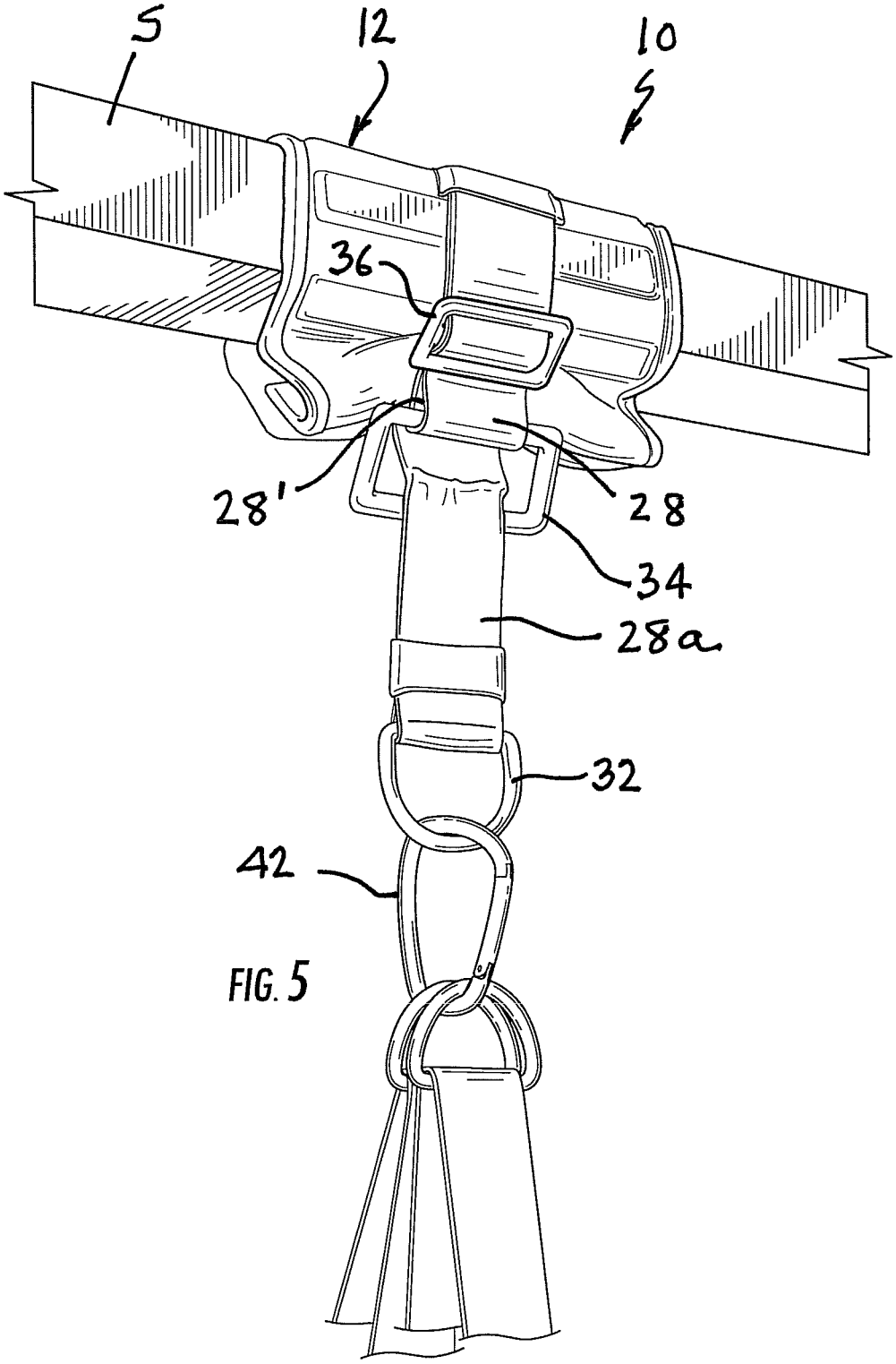
FIG. 5 is a perspective view of the universal heavy bag hanger shown in FIG. 3 with a heavy bag suspended from the hanger.

Referring to FIGS. 3-5, the method of wrapping of universal heavy bag hanger of the invention about a support member S will now be described. The strap 28 is wrapped around the support member S to bring the two free ends 28*a*, 28*b* together and the D-shaped ring 32 is inserted through the rectangular ring 34. The strap 28 can now be pulled downwardly to form a slip joint, not unlike a common slip knot, in which the resulting loop is shortened and the loop is tightened about an object when tension is applied to the free end of the line. A heavy bag (not shown) may now be attached to the D-shaped ring 32 by means of a snap hook or spring snap 42, preferably one provided with a swivel eye so that a punching bag supported on the D-shaped ring can rotate or swivel about the ring about its own axis. The resulting slip joint tightens the strap 28 about the flat pad 12 and the support member S with increasing tensions applied when downwardly directed forces are applied to the end 28*a* of the strap. Resulting constricting action of the strap 28 about the pad 12 increases the frictional forces between the slip resistant material 16 and the support member S to prevent sliding movements of the bag hanger along or relative to the support when force components along the length and/or transverse width directions are applied to the D-shaped ring and a heavy bag or other like heavy object attached to the D-shaped ring. The heavier the bag the tighter is the resulting joint and the greater the frictional components are created inhibiting sliding movements along the support member.

The universal heavy bag hanger is quick, convenient and requires no tools whatsoever to secure to an overhead support member. Removal of the bag hanger from the support S is equally simple, simply requiring that the heavy bag be removed from the D-shaped ring 32 and the slip joint loosened and the joint opened by removing the D-shaped ring 32 and the free end of the strap 28*a* from the rectangular ring 34.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What we claim:

1. Universal heavy bag hanger for securing a heavy bag to an overhead horizontal support member having a predetermined substantially uniform cross-section defining a girth or perimeter dimension comprising:

an elongate generally flat flexible pad defining a length direction and a transverse width direction and a longitudinal length along said length direction greater than said girth or perimeter dimension to at least partially wrap around the support member, said pad having an inside surface for contacting the support member and an opposing outside surface and free longitudinal ends along said longitudinal length;

a slip-resistant material on at least a part of said inside surface, said slip resistant material exhibiting friction comparable to that of rubber;

a continuous strap of substantially uniform width extending coextensively over and in contact with said outside surface of said strap along said longitudinal Length and extending beyond said longitudinal ends of said flat flexible pad;

retaining means fixed to said outside surface of said flat flexible pad for retaining said strap in contact with said outside surface of said flat flexible pad while enabling said strap to slide over the entire longitudinal extent or length of said flat flexible pad, and said strap having two free ends, first attachment means attached to one free end of said strap for attaching to a heavy bag; and second attachment means attached to another free end of said strap dimensioned to allow free passage of said first attachment means and said one free end of said strap therethrough for cooperating with said one free end to form a slip joint for tightening said strap about said flat pad and the support member with increasing tensions applied to said other free end while said strap slides relative to said flat flexible pad; and force distributing means for distributing normal forces applied to said strap to the support member, said force distributing means comprising a plurality of substantially spaced parallel rigid bars oriented within pockets along a direction generally normal to said length direction of said flat pad, whereby resulting constricting action of said strap about said pad increases the frictional forces between said slip-resistant material and the support member to thereby prevent sliding movements therebetween when force components are applied along said length and transverse width directions to said first attachment means and the heavy bag attached to said first attachment means.

2. A universal heavy bag hanger as defined in claim 1, wherein said flat pad is formed of superimposed top and bottom sheets and said bottom sheet made of a slip resistant material.

3. A universal heavy bag hanger as defined in claim 2, wherein said slip resistant material is a rubberized material.

4. A universal heavy bag hanger as defined in claim 3, wherein said rubberized material is textured neoprene rubber.

5. A universal heavy bag hanger as defined in claim 1, further comprising connecting means for connecting said longitudinal ends of said flat pad to each other after being wrapped around the horizontal support prior to application of tension to said strap and constricting of said pad about the support.

6. A universal heavy bag hanger as defined in claim 5, wherein said connecting means comprises mating hook and loop fasteners.

7. A universal heavy bag hanger as defined in claim 6, wherein one of said hook and loop fasteners is attached to one longitudinal end of said inside surface and an other of said hook and loop fasteners is attached to the other longitudinal end of said outside surface, whereby wrapping said pad about a support member contacting said hook and loop fasteners provides at least a temporary connection between said longitudinal ends until said strap is tightened about the support member.

8. A universal heavy bag hanger as defined in claim 2, wherein top sheet is formed of PVC sheet material.

9. A universal heavy bag hanger as defined in claim 8, wherein said PVC sheet material is reinforced with a polyester backing.

10. A universal heavy bag hanger as defined in claim 1, wherein said strap is formed of polypropylene webbing.

11. A universal heavy bag hanger as defined in claim 1, wherein said first attachment means comprises a first closed ring.

12. A universal heavy bag hanger as defined in claim 11, wherein said first closed ring is a D-ring.

13. A universal heavy bag hanger as defined in claim 11, wherein said second attachment means comprises a second closed ring dimensioned to allow said first closed ring to pass therethrough.

14. A universal heavy bag hanger as defined in claim 13, wherein said first closed ring comprises a D-ring and said second closed ring is a rectangular ring dimensioned to allow said D-ring to pass therethrough to form said slip joint.

15. A universal heavy bag hanger as defined in claim 1, further comprising strap-length adjusting means for adjusting the length of said strap.

16. A universal heavy bag hanger as defined in claim 15, wherein said strap-length adjusting means comprises a slide buckle that functionally fixes the length of said strap at a selected length thereof.

17. A universal heavy bag hanger as defined in claim 1, wherein said flat pad is formed of superimposed top and bottom sheets and said bottom sheet made of a slip resistant material and said top and bottom sheets are attached to form elongate said pockets therebetween to receive said bars.

18. Universal heavy bag hanger for securing a heavy bag to an overhead horizontal support member having a predetermined substantially uniform cross-sectional girth or perimeter comprising:

an elongate generally flat flexible pad defining a length direction and a transverse width direction and a longitudinal length along said length direction greater than said girth or perimeter dimension to at least partially wrap around the support member, said pad having an inside surface for contacting the support member and an opposing outside surface and free longitudinal ends along said longitudinal length;

a slip-resistant material on at least a part of said inside surface, said slip resistant material exhibiting friction comparable to that of rubber;

a continuous strap of substantially uniform width extending coextensively over and in contact with said outside surface of said strap along said longitudinal length and extending beyond said longitudinal ends of said flat flexible pad;

first attachment means attached to one free end of said strap for attaching to a heavy bag; and second attachment means attached to another free end of said strap for cooperating with said one free end of said strap to form a slip joint for tightening said strap about said flat pad and the support member with increasing tensions applied to said other free end while said strap slides relative to said flat flexible pad; and force distributing means for distributing normal forces applied to said strap to the support member, said force distributing means comprising a plurality of substantially spaced parallel rigid bars oriented within pockets along a direction generally normal to said length direction of said flat pad, whereby resulting constricting action of said strap about said pad increases the frictional forces between said slip-resistant material and the support member to thereby prevent sliding movements therebetween when force components along said length and transverse width directions are applied to said first attachment means and a heavy bag or the like attached to said first attachment means.

* * * * *